US009685284B1

(12) United States Patent
Chu

(10) Patent No.: US 9,685,284 B1
(45) Date of Patent: Jun. 20, 2017

(54) PUSH-TYPE SWITCH WITH SOUND FEEDBACK

(71) Applicant: Ching-Hsiung Chu, Taipei (TW)

(72) Inventor: Ching-Hsiung Chu, Taipei (TW)

( * ) Notice: Subject to any disclaimer, the term of this patent is extended or adjusted under 35 U.S.C. 154(b) by 0 days.

(21) Appl. No.: 15/181,431

(22) Filed: Jun. 14, 2016

(30) Foreign Application Priority Data

Apr. 26, 2016 (TW) ..... 105112906 A

(51) Int. Cl.
*H01H 13/04* (2006.01)
*G08B 3/10* (2006.01)

(52) U.S. Cl.
CPC ..... *H01H 13/04* (2013.01); *G08B 3/10* (2013.01); *H01H 2215/03* (2013.01); *H01H 2219/037* (2013.01)

(58) Field of Classification Search
CPC ..... H01H 13/04; H01H 2215/03; H01H 2219/037; H01H 13/48; H01H 2227/026; G08B 3/10
USPC ..... 200/303, 406, 341–342, 345, 511, 513, 200/516–517, 520, 521
See application file for complete search history.

(56) References Cited

U.S. PATENT DOCUMENTS 2,399,867 A * 5/1946 Hetherington ..... H01H 13/36 200/406
6,585,391 B1 * 7/2003 Koch ..... F21L 4/005 200/512
7,652,216 B2 * 1/2010 Sharrah ..... H01H 13/64 200/1 B

* cited by examiner

*Primary Examiner* — Edwin A. Leon

(57) ABSTRACT

A push-type switch with sound feedback, includes a casing having a plurality of positioning slots, a movable seat, a cap lid, a conducting unit, and an audio module. The movable seat includes a wall body, an interference element, and multiple engaging portions movably connected to the positioning slots. The conducting unit includes a conducting module which forms a conducting space and includes a base board, a connecting element, and at least an audio element built in with at least an audio message. When the cap lid is depressed to enable the movable seat to move, the interference element moves in conjunction with the movable seat into the conducting space, whereby allowing the conducting unit to generate and transmit an electrical signal to actuate an electronic product and the audio element concurrently playing the audio message so that users are able to recognize a controlling state of the switch.

9 Claims, 6 Drawing Sheets

PUSH-TYPE SWITCH WITH SOUND FEEDBACK

BACKGROUND OF THE INVENTION

1. Field of the Invention

The present invention relates to a switch, and particularly to a push-type switch being capable of providing sound feedback for recognizing a controlling state.

2. Related Art

A conventional push type switch includes a cap lid, a base seat, and a conducting apparatus installed therein. By depressing the cap lid, the conducting apparatus is electrically triggered to generate and transmit electrical signals to an applied product so as to control an applied product. However, the conducting apparatus of a conventional push type switch is generally conducted through mutual contact of metallic terminals, or through sensing contact of two conductive elements. Unfortunately, after being used for a period of time, not only the metallic terminals tend to result in ineffective contact due to material fatigue, but the conductive elements also are inclined to cause ineffective sensing because of moisture or dust which remains on a printed circuit board. Furthermore, conventional push type switches fail to provide feedback on the pressing of switches, and it is therefore very difficult for users to recognize whether the switches have been properly pressed. As a result, a conventional push type switch is improved to be equipped with lighting elements for emitting light upon depression of the switch so as to help users recognize a push state of the switch. However, light emitted by the lighting elements is not easy to be seen at a place of greater brightness. Besides, lighting effect is not capable of delivering information to users other than showing the pressing state of the switch. In other words, by means of colors or brightness of the light of the lighting elements, it is still difficult for users to understand what functions of the applied product is being performed by the switch.

SUMMARY OF THE INVENTION

Accordingly, an object of the present invention is to provide a push-type switch with sound feedback which enables users to easily recognize the controlling state of the push-type switch.

Another object of the present invention is to provide a push-type switch which is triggered though the interaction of infrared.

To achieve the above-mentioned objects, the push-type switch of the present invention comprises a casing comprising an upper casing portion and a lower casing portion, the upper casing portion including a plurality of positioning slots. A movable seat comprises a wall body, an interference element, and multiple engaging portions being movably connected to the plurality of positioning slots, the wall body forming a hollow portion therein, two opposite ends of the hollow portion open to outside. A cap lid is mounted onto the movable seat and covers the hollow portion. A conducting unit is disposed in the lower casing portion and comprises a circuit board, an electrical connector disposed on one side of the circuit board. A conducting module is disposed on another side of the circuit board, the conducting module including a conducting space, the electrical connector configured to be connected with an electronic product. An audio module comprises a base board, a connecting element, and at least an audio element built in with at least an audio message and configured on the base board, the base board disposed in the hollow portion, one end of the connecting element connected to the base board, and another end of the connecting element passing through a bottom of the movable seat to electrically connect the circuit board of the conducting unit. When the cap lid is depressed to enable the movable seat to move toward the lower casing portion, the interference element moves in conjunction with the movable seat into the conducting space of the conducting module, whereby allowing the conducting unit to generate and transmit an electrical signal to actuate the electronic product and the audio element concurrently playing the audio message so that users are able to recognize a controlling state of the switch.

In one aspect of the present invention, the wall body of the movable seat comprises a circular wall and a conical wall integrally formed with and extending from a top of the circular wall, the conical wall is gradually reduced in diameter in a downward direction, the engaging portions protrude outward from an outer surface of the circular wall, and the interference element has a board-like shape and is disposed on an outer surface of the conical wall opposite to the hollow portion.

In another aspect of the present invention, the push-type switch further comprises at lease a lighting element disposed on the base board, the cap lid comprises at least a light-permeable portion, and when the conducting unit generates the electrical signal, the at least a lighting element emits light with at least a lighting mode where the light emitted by the lighting element is permeable to the light-permeable portion so as to enable users to further recognize the controlling state of the switch.

In another aspect of the present invention, the conducting module further includes a transmitting element, a receiving element, and the conducting space formed between the transmitting element and the receiving element, the transmitting element constantly transmits a signal passing though the conducting space for being received by the receiving element, and when the interference element moves into the conducting space to block the signal received by the receiving element, the conducting unit generates and transmits the electrical signal to actuate the electronic product and to enable the audio element to concurrently play the audio message.

The push-type switch of the present invention utilizes the audio module to play the audio message as feedback so as to enable users to recognize the controlling state of the switch, and utilize the lighting elements to emit light for providing further feedback to the push of the switch, whereby successfully overcoming the drawbacks of convention switches that are poor in providing feedback on a controlling state of the switch and are failure to let users recognize what functions of an electronic product are performed.

DESCRIPTION OF THE PREFERRED EMBODIMENTS

Figure 1:
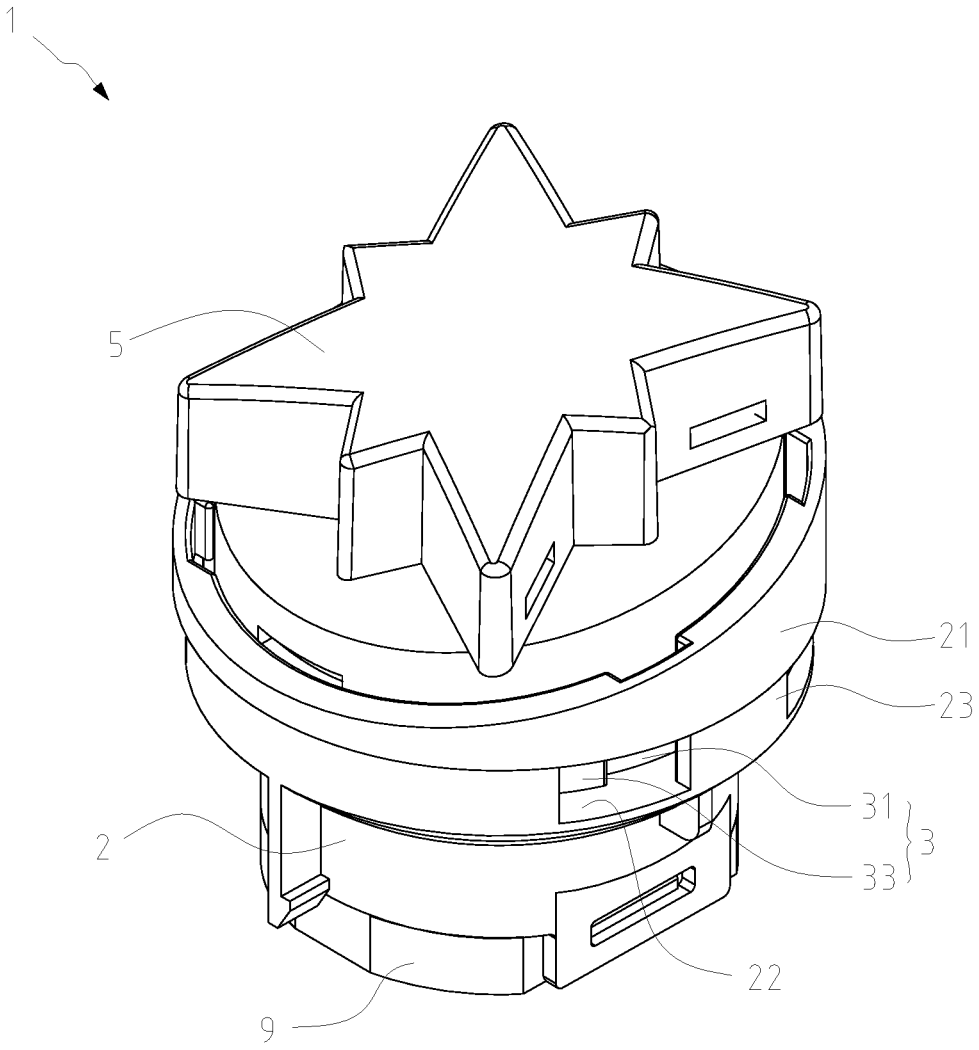
FIG. 1 is a perspective assembly view of a push-type switch of the present invention.
Figure 2:
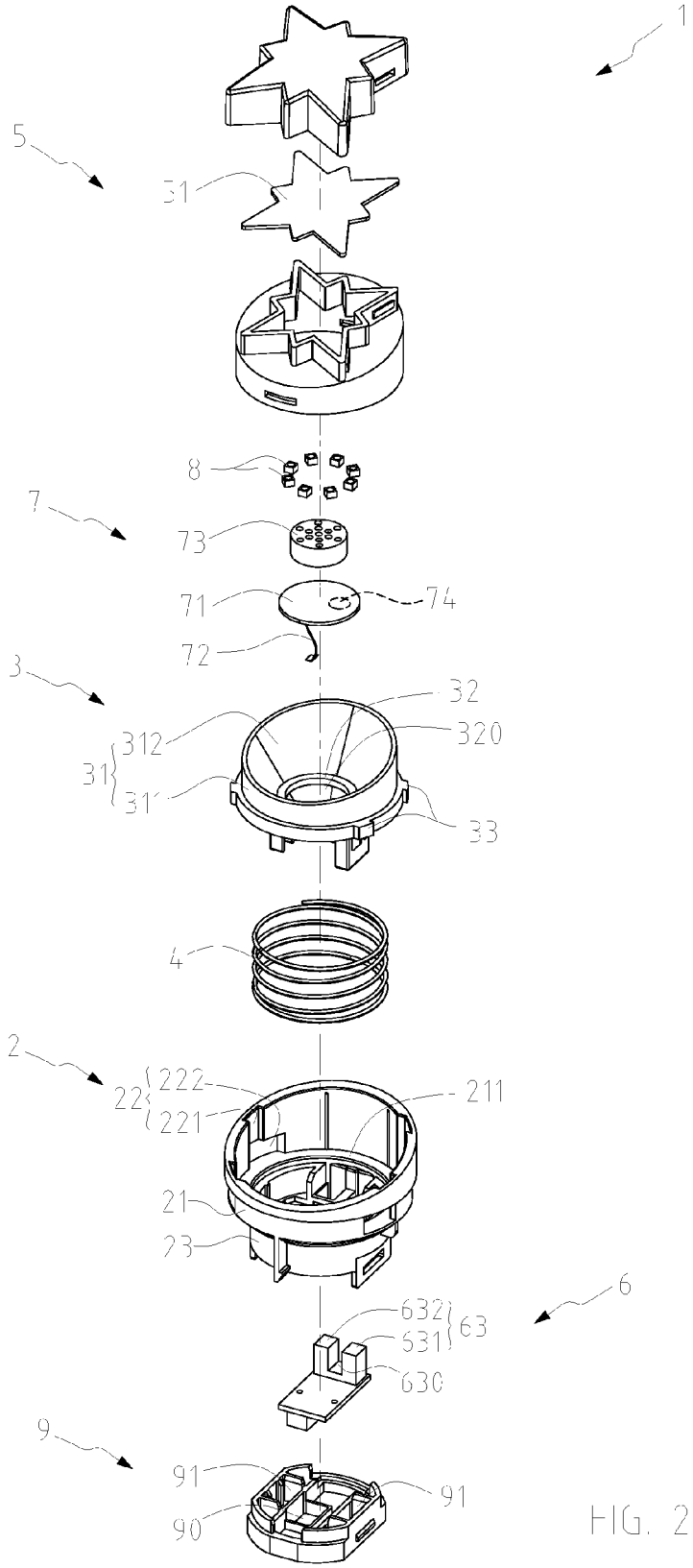
FIG. 2 is a perspective exploded view of FIG. 1.

Referring to FIGS. 1 to 4 showing a preferred embodiment of a push-type switch with sound feedback of the present invention, the push-type switch 1 of the present invention is applicable to a variety of electronic products, electric appliances, controlling panels of vehicles, controllers of gaming consoles, or controllers of payment machines. The push-type switch 1 comprises a casing 2, a movable seat 3, a resilient element 4, a cap lid 5, a conducting unit 6 and an audio module 7. The casing 2 has a round sectional shape and comprises an upper casing portion 21 and a lower casing portion 22 integrally formed with the upper casing portion 21. The upper casing portion 21 includes four positioning slots 22 formed on an inner surface of the upper casing portion 21 (as shown in FIG. 2). The positioning slots 22 are spaced apart from each other and each positioning slot 22 comprises a guiding portion 221 and a bending portion 222 extending and beading from the guiding portion 221, such that the guiding portion 221 and the bending portion 222 cooperatively form an L shape where the bending portion 222 is located below the guiding portion 221, and the guiding portion 221 extends upward to a top of the upper casing portion 21. A flange portion 211 is formed on the inner surface of the upper casing portion 21 and located below and adjacent to the positioning slot 22.

Figure 4:
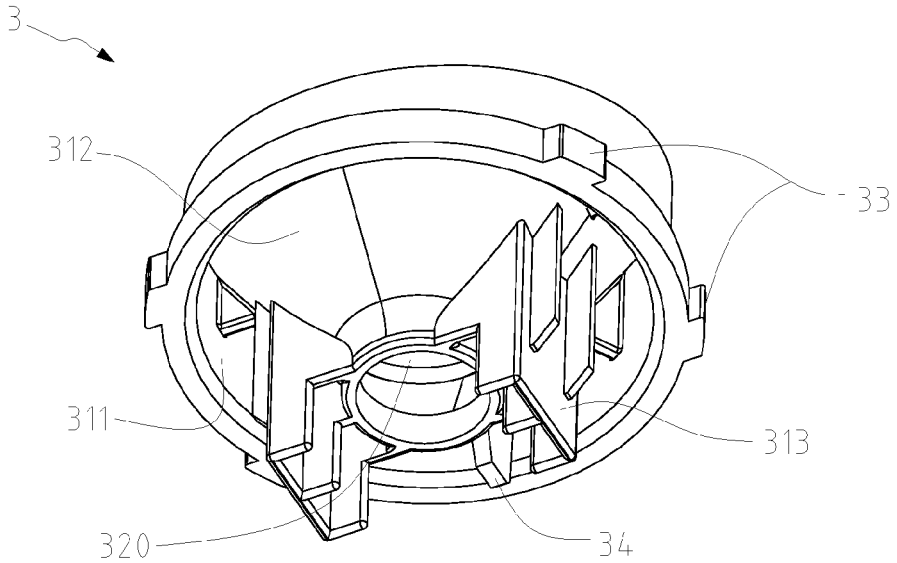
FIG. 4 is a bottom side perspective view of a moveable seat of the present invention.

The movable seat 3 comprises a wall body 31. In the preferable embodiment, the wall body 31 comprises a circular wall 311 and a conical wall 312 which is internally formed with and extends from a top of the circular wall 311. The conical wall 312 is gradually reduced in diameter in a downward direction. In other words, a diameter at a top of the conical wall 312 is greater than a diameter at a bottom thereof. The conical wall 312 forms a hollow portion 310 therein, two opposite ends of the hollow portion 310 being open to outside. The circular wall 311 surrounds a top of the conical wall 312, and four engaging portions 33 are formed on an outer surface of the circular wall 311. The engaging portions 33 are spaced apart from each other and respectively protrude outward. A platform 32 is formed on and around an inner surface of the conical wall 311 and is located in the hollow portion 310 below the positioning slots 22. The platform 32 forms a through hole 320 in a middle thereof which communicates with the hollow portion 310 and a bottom of the conical wall 312. Furthermore, an interference element 34 and a plurality of fixing portions 313 are disposed on an outer surface of the conical wall 312 opposite to the hollow portion 310 (as shown in FIG. 4). The interference element 34 has a board-like shape and extends perpendicularly downward. The fixing portions 313 are located opposite to each other and respectively extend downward. It is noted that the movable seat 3 is movable connected with the casing 2 through the engagement of the engaging portions 33 and the positioning slots 22. Specifically, each of the engaging portions 33 is inserted into the guiding portion 221 so as to be engaged with the bending portion 222 upon rotation of the movable seat 3. Particularly, the bending portion 222 has a height larger than a height of the engaging portion 33 so as to allow the engaging portion 33 to be movable in a perpendicular direction within the bending portion 222. The bending portion 222 of the positioning slot 22 is configured not only to connect the engaging portion 33 but also to limit the travel course of the movable seat 3.

The resilient element 4 is mounted to the movable seat 3 and disposed between the casing 2 and the movable seat 3, so as to allow the movable seat 3 to automatically move back to a position where the moveable seat 3 is not yet depressed to move (as described below). In the preferable embodiment, the resilient element 4 is a compressing spring, one end of which is propped against the outer surface of the conical wall 312, and the other end of which is propped against the flange portion 211 of the casing 2.

The cap lid 5 is mounted onto the movable seat 3 and covers the hollow portion 310 where peripheral side walls of the cap lid 5 surround the circular wall 311 and are located between the circular wall 311 and the upper casing portion 21. The cap lid 5 comprises at least a light-permeable portion 51 which has a sheet-like shape (as shown in FIG. 2) and allows light to permeate therefrom but is not completely transparent. The light-permeable portion 51 is disposed inside the cap lid 5. A top of the cap lid 5 is transparent so that the light-permeable portion 51 can be seen from the cap lid 5, but internal components of the push-type switch 1 will not be seen from outside. The light-permeable portion 51 and the top of the cap lid 5 can be customized to have a desired profile.

Figure 5:
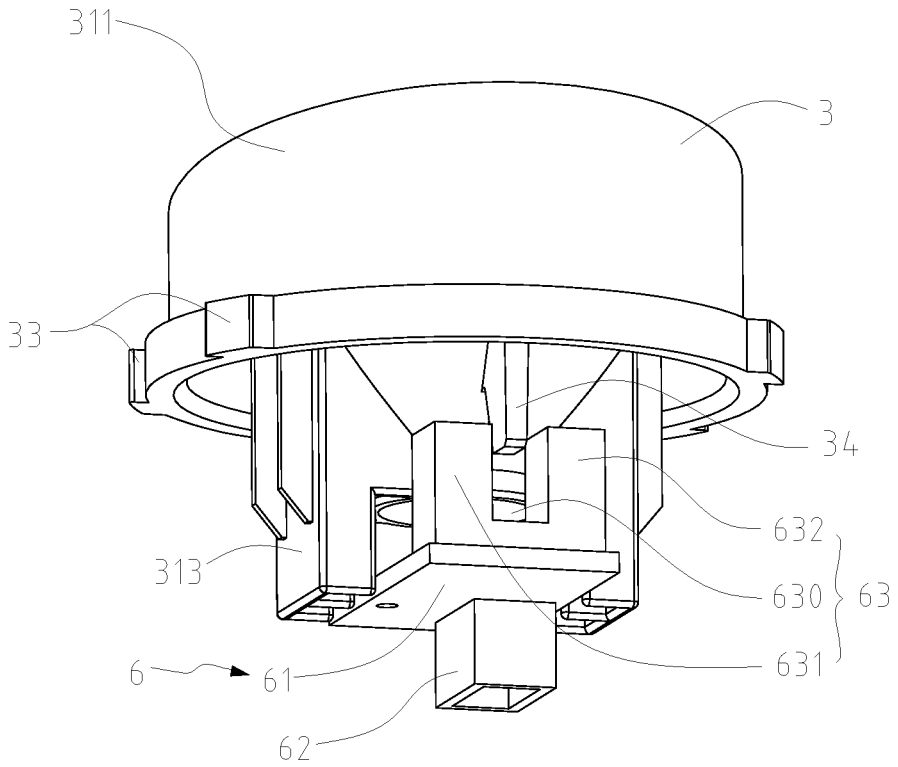
FIG. 5 is a rear bottom perspective assembly view of a conducting unit and the movable seat of the present invention.
Figure 6:
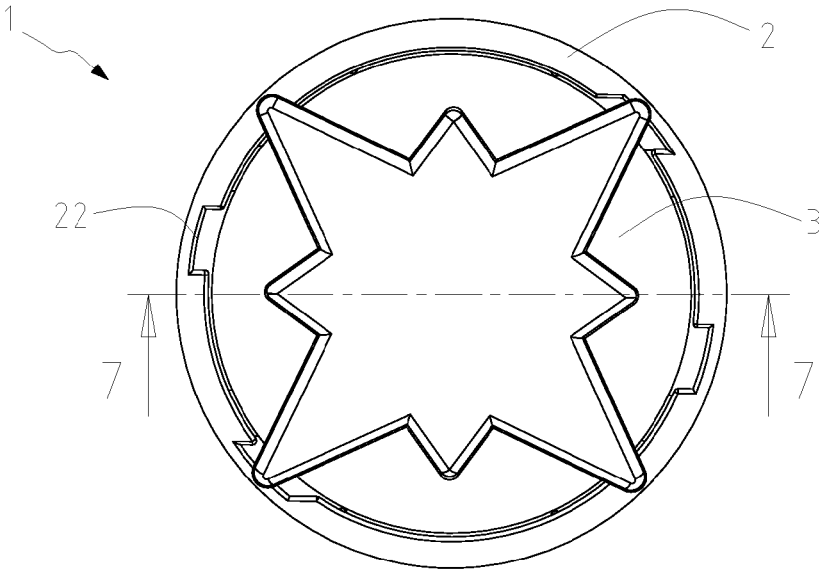
FIG. 6 is a top plan view of FIG. 1.

The conducting unit 6 is disposed in the lower casing portion 23 and comprises a circuit board 61, an electrical connector 62 disposed on one side of the circuit board 61, and a conducting module 63 disposed on another side of the circuit board 61 and adjacent to one end of the circuit board 61. The conducting module 63 includes a transmitting element 631, a receiving element 632, and a conducting space 630 formed between the transmitting element 631 and the receiving element 632. The transmitting element 631 constantly transmits a signal passing though the conducting space 630 for being received by the receiving element 632, wherein the conducting space 630 is open upward and laterally. The electrical connector 62 is provided to be connected with an electronic product (not shown). In this embodiment, the signal transmitted by the transmitting element 631 is infrared. The conducting module 63 is located between the conical wall 312 and the casing 2 where the conducting space 630 is directly under the interference element 34 (as shown in FIG. 5).

Figure 7:
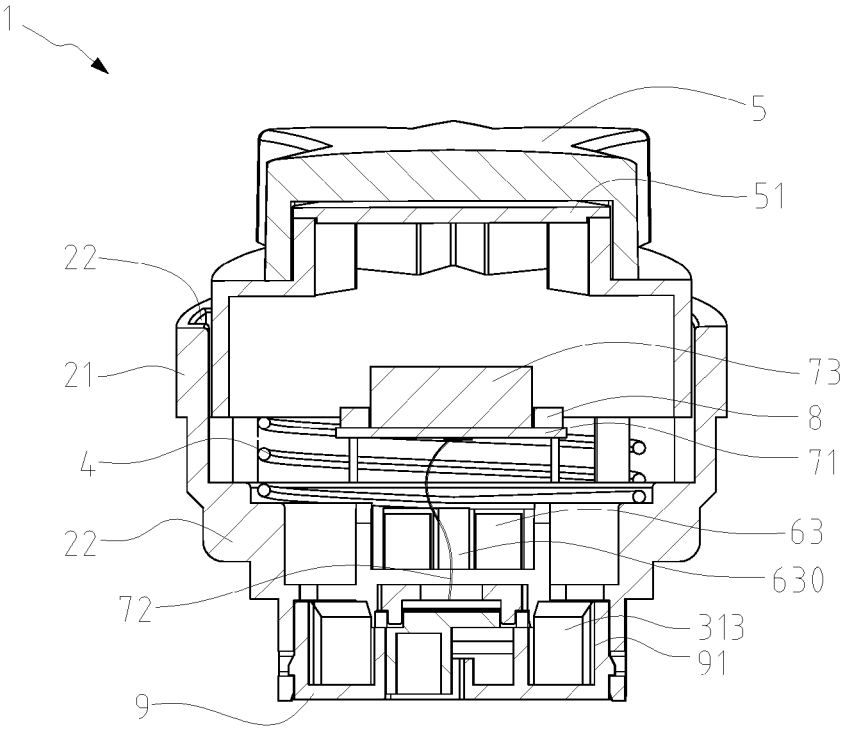
FIG. 7 is a cross-sectional view taken along line 7-7 of FIG. 6.

The audio module 7 comprises a base board 71, a connecting element 72, and at least an audio element 73. The base board 71, which functions as a printed circuit board, is disposed on the platform 32 and completely covers the through hole 320 of the platform 32. In the preferable embodiment, the connecting element 72 is exemplified by a flat flexible cable, one end of which is connected to the base board 71, another end of which passes through the through hole 320 and a bottom of the movable seat 3 to electrically connect the circuit board 61 (as shown in FIG. 7). Alternatively, the connecting element 72 is exemplified by multiple metal terminals (not shown). The audio element 73 is disposed in the hollow portion 310 and is built with at least an audio message, which contains pre-recorded speech messages or sound effect for responding to depression of the switch 1. The audio element 73, for example, can be a micro speaker.

Figure 3:
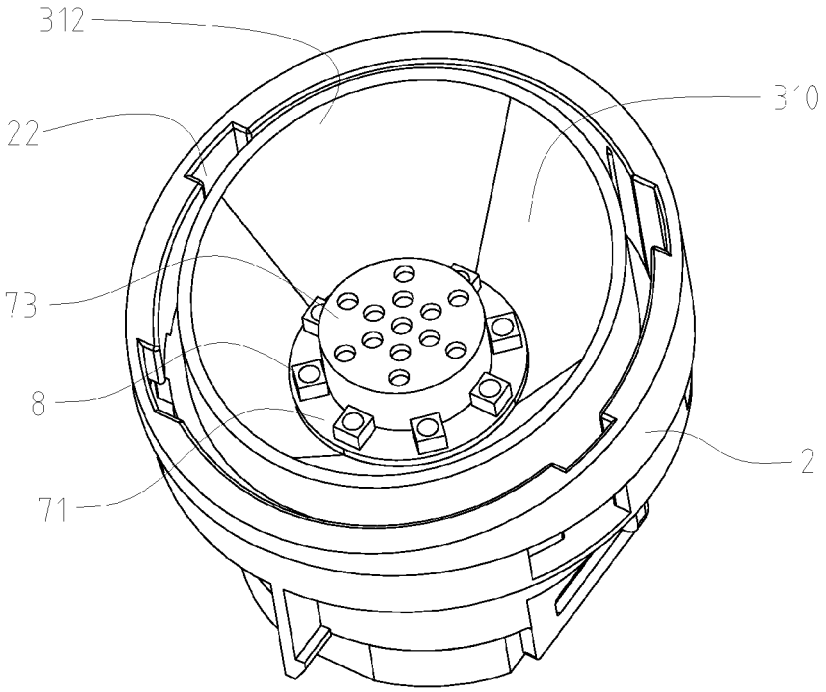
FIG. 3 is a partially perspective view of the push-type switch where a cap lid is removed.

Referring to FIGS. 1 and 2, the push-type switch 1 further comprises a bottom cover 9 for securing the connection of the casing 2 and the movable seat 3. The bottom cover 9 comprises two limiting slots 91 located opposite to each other. Two opposite sides of the bottom cover 9 are configured to be fastened with corresponding structures provided on the lower casing portion 23 so as to cover the bottom of the lower casing portion 23. When the engaging portions 33 of the movable seat 1 are engaged with the plurality of positioning slots 22 upon rotation of the movable seat 3, the fixing portions 313 are in alignment with the limiting slots 91 and are therefore being inserted into the limiting slots 91. In this manner, the engagement of the fixing portions 313 and the limiting slots 91 prevents the movable seat 3 from being rotated in a reverse direction to disengage from the casing 2. The bottom cover 9 further forms a bottom hole 90 corresponding to the electrical connector 62 of the conducting unit 6 for allowing an external cable (not shown) to connect the electrical connector 62. As shown in FIGS. 2 and 3, the push-type switch 1 further comprise a plurality of lighting elements 8 which are disposed on the base board 71 and arranged around the audio element 73. The lighting elements 8, for example, are light emitting diodes.

Figure 8:
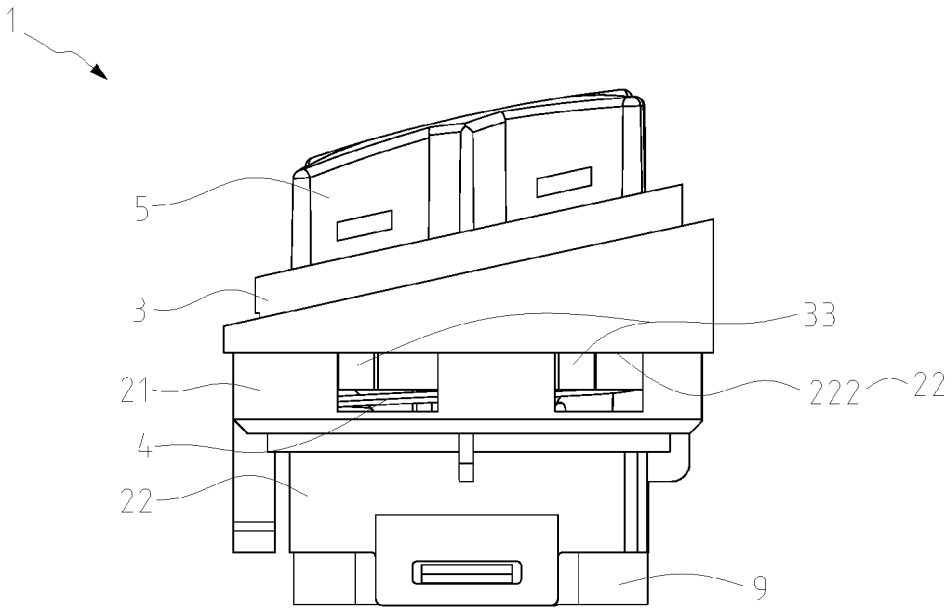
FIG. 8 is a right side elevation view of FIG. 1.
Figure 9:
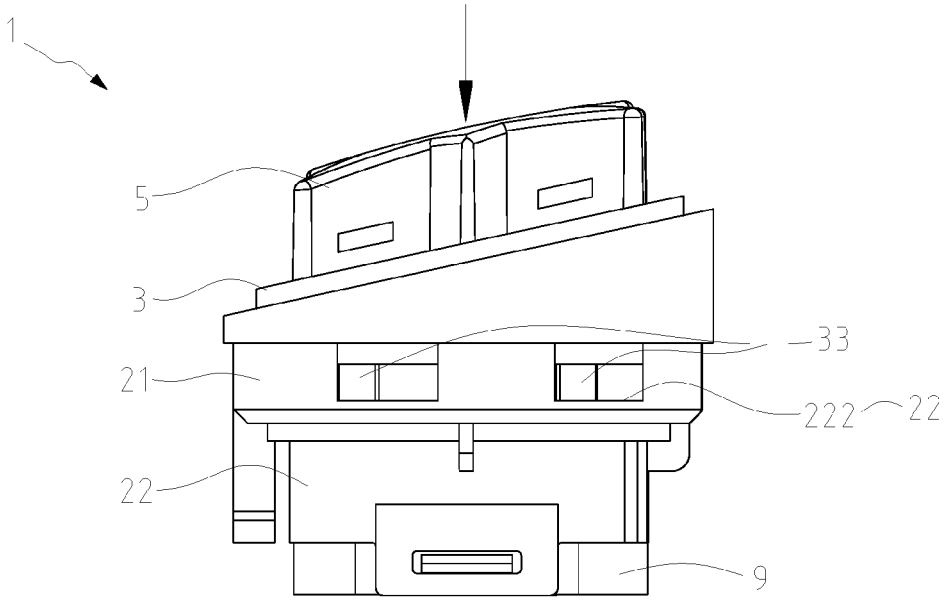
FIG. 9 is a schematic operational view of the push-type switch of the present invention.

In use of the push-type switch 1, the cap lid 5 is being depressed to deform the resilient element 4 so as to allow the movable seat 3 to move in a direction toward the lower casing portion 23, the engaging portions 33 concurrently moves in the bending portions 222 and abut against lower edges of the bending portions 222 (as shown in FIG. 9). Meanwhile, the interference element 34 moves downward in conjunction with the movable seat 3 to enter the conducting space 630 whereby blocking the infrared transmitted by the transmitting element 631, so as to enable the conducting unit 6 to generate and transmit an electrical signal to actuate the electronic product and the audio element 73 concurrently playing the audio message so that users are able to recognize a controlling state of the switch 1, inasmuch as whether the switch 1 is being actually depressed and what functions of the electronic product are performed. Additionally, the lighting elements 8 emit light at the time that the audio element 73 plays the audio message where the light being emitted is permeable to the light-permeable portion 51 and the cap lid 5 so as to enable users to further recognize the switch 1 is properly pushed. Likewise, when the cap lid 5 is not being depressed, a depressing force applied on the resilient element 4 is released such that the resilient element 4 pushes the movable seat 3 upward, and the engaging portions 33 move to abut against upper edges of the bending portions 222 (as shown in FIG. 8), where the movable seat 3 automatically return to a position of not being depressed. In other words, if the switch 1 is not properly pushed, the signal of infrared is not blocked by the interference element 34, and the audio element 73 would not play the audio message and the lighting elements 8 would not emit light. With the above-mentioned structures, the audio message being played and the light being emitted are to be refracted by the conical wall 312 to be delivered outward, and because the base board 71 completely covers the through hole 320, the audio message being played would not leak though the through hole 320.

Particularly, the base board 71 is further provided with an audio recording element 74 (as shown in FIG. 2) for recording external sounds which are then being converted by the audio module 7 to the audio message. In a preferable embodiment, an external electronic product (not shown) having a function of audio play, for example, such as a smart phone, is capable of being connected with a cable to the electrical connector 62, so as to allow the audio recording element 74 to synchronously record the audio from the electronic product.

Accordingly, the push-type switch 1 of the present invention utilizes the audio module 7 to play the audio message as feedback so as to enable users to recognize the controlling state of the switch, and utilize the lighting elements 8 to emit light for providing further feedback to the push of the switch 1, whereby successfully overcoming the drawbacks of convention switches that are poor in providing feedback on a controlling state of the switch and are failure to let users recognize what functions of an electronic product are performed.

It is understood that the invention may be embodied in other forms within the scope of the claims. Thus the present examples and embodiments are to be considered in all respects as illustrative, and not restrictive, of the invention defined by the claims.

What is claimed is:

1. A push-type switch with sound feedback, comprising:

a casing comprising an upper casing portion and a lower casing portion, the upper casing portion including a plurality of positioning slots;

a movable seat comprising a wall body, an interference element, and multiple engaging portions being movably connected to the plurality of positioning slots, the wall body forming a hollow portion therein, two opposite ends of the hollow portion open to outside;

a cap lid mounted onto the movable seat and covering the hollow portion;

a conducting unit disposed in the lower casing portion and comprising a circuit board, an electrical connector disposed on one side of the circuit board, and a conducting module disposed on another side of the circuit board, the conducting module including a conducting space, the electrical connector configured to be connected with an electronic product; and an audio module comprising a base board, a connecting element, and at least an audio element built in with at least an audio message and configured on the base board, the base board disposed in the hollow portion, one end of the connecting element connected to the base board, and another end of the connecting element passing through a bottom of the movable seat to electrically connect the circuit board of the conducting unit;

wherein when the cap lid is depressed to enable the movable seat to move toward the lower casing portion, the interference element moves in conjunction with the movable seat into the conducting space of the conducting module, whereby allowing the conducting unit to generate and transmit an electrical signal to actuate the electronic product and the audio element concurrently playing the audio message so that users are able to recognize a controlling state of the switch.

2. The push-type switch of claim 1, wherein the wall body of the movable seat comprises a circular wall and a conical wall integrally formed with and extending from a top of the circular wall, the conical wall is gradually reduced in diameter in a downward direction, the engaging portions protrude outward from an outer surface of the circular wall, and the interference element has a board-like shape and is disposed on an outer surface of the conical wall opposite to the hollow portion.

3. The push-type switch of claim 2, wherein each of the positioning slots comprises a guiding portion and a bending portion extending and beading from the guiding portion, the guiding portion and the bending portion cooperatively forming an L shape where the bending portion is located below the guiding portion, the guiding portion extending upward to a top of the upper casing portion, each of the engaging portions being inserted into the guiding portion so as to be engaged with the bending portion upon rotation of the movable seat, and the bending portion having a height larger than a height of the engaging portion so as to allow the engaging portion to be movable in a perpendicular direction.

4. The push-type switch of claim 3, further comprising a bottom cover covering a bottom of the lower casing portion, the bottom cover comprises a plurality of limiting slots, the conical wall has a plurality of fixing portions formed on the outer surface of the conical wall opposite to the hollow portion, and when the engaging portions are engaged with the plurality of positioning slots upon rotation of the movable seat, the fixing portions are capable of being inserted into the limiting slots.

5. The push-type switch of claim 1, wherein the wall body of the movable seat has a platform located in the hollow portion and forming a through hole to communicate with the hollow portion, wherein the base board of the audio module is disposed on the platform and completely covers the through hole in order to prevent the audio message played by the audio element from leaking though the through hole.

6. The push-type switch of claim 1, further comprising a resilient element mounted to the movable seat and disposed between the casing and the movable seat, so as to allow the movable seat to automatically move back to a position where the cap lid is not yet depressed.

7. The push-type switch of claim 1, further comprising at lease a lighting element disposed on the base board, the cap lid comprises at least a light-permeable portion, and when the conducting unit generates the electrical signal, the at least a lighting element emits light with at least a lighting mode where the light emitted by the lighting element is permeable to the light-permeable portion so as to enable users to further recognize the controlling state of the switch.

8. The push-type switch of claim 1, wherein the base board is further provided with an audio recording element for recording external sounds which are then being converted by the audio module into the audio message.

9. The push-type switch of claim 1, wherein the conducting module further includes a transmitting element, a receiving element, and the conducting space formed between the transmitting element and the receiving element, the transmitting element constantly transmits a signal passing though the conducting space for being received by the receiving element, and when the interference element moves into the conducting space to block the signal received by the receiving element, the conducting unit generates and transmits the electrical signal to actuate the electronic product and to enable the audio element to concurrently play the audio message.

* * * * *